US008858033B1

(12) United States Patent
Simon

(10) Patent No.: US 8,858,033 B1
(45) Date of Patent: Oct. 14, 2014

(54) LAMP CHANGE SYSTEM FOR LUMINAIRES USING QUASI POINT LIGHT SOURCES AND RELATED HEAT SINKING

(76) Inventor: Jerome H. Simon, Newton Centre, MA (US)

( * ) Notice: Subject to any disclaimer, the term of this patent is extended or adjusted under 35 U.S.C. 154(b) by 630 days.

(21) Appl. No.: 12/965,430

(22) Filed: Dec. 10, 2010

Related U.S. Application Data

(60) Provisional application No. 61/284,059, filed on Dec. 11, 2009.

(51) Int. Cl.
*F21V 29/00* (2006.01)

(52) U.S. Cl.
CPC ..... *F21V 29/004* (2013.01)
USPC ..... 362/294

(58) Field of Classification Search
CPC ..... F21V 29/004
USPC ..... 362/294
See application file for complete search history.

(56) References Cited

U.S. PATENT DOCUMENTS

2007/0189029 A1* 8/2007 Zhang ..... 362/546
2008/0030987 A1* 2/2008 Simon ..... 362/234

* cited by examiner

*Primary Examiner* — Anh Mai
*Assistant Examiner* — Hana Featherly
(74) *Attorney, Agent, or Firm* — Burns & Levinson, LLP; Jerry Cohen; David W Gomes

(57) ABSTRACT

A composite lighting component system having at least one first component which is a light module, each such light module being disposed on a common optical axis, and each including at least one of the following subcomponents:

an LED;

a heat transfer element onto which the LED is mounted to remove heat generated from the LED, the heat transfer element including mechanical elements configured to provide a secure yet removable attachment; and a thermal interface onto a second component which is a heat sink assembly, including at least one heat transfer element configured to provide a secure yet removable attachment and a thermal interface with the heat transfer element of the first component lighting module. The composite lighting component system includes a third component being electrical continuity system including subcomponents, any of which is so configured and disposed as to not obstruct light emanating from the light module.

14 Claims, 8 Drawing Sheets

LAMP CHANGE SYSTEM FOR LUMINAIRES USING QUASI POINT LIGHT SOURCES AND RELATED HEAT SINKING

This application claims the benefit of priority from U.S. Ser. No. 61/284,059 filed Dec. 11, 2009, the entire content of which is hereby incorporated herein by reference.

PURPOSE OF THE INVENTION

To provide a system for changing heat dissipation dependent light sources that must have direct and substantial contact with heat sink configuration within a luminaire or luminaire system without removing and/or discarding the heat sink configuration.

To provide a cost effective lamp change system without discarding expensive materials in the lamp change process.

To provide multiple and varied types of light distribution from a "bulb-like" change out module.

To provide a uniform and constant system that can be used in a variety of luminaire products and their associated applications.

To provide efficient illumination through the use of bulbs that project precise illumination to multiple specific target areas.

PREFERRED EMBODIMENTS

Figures 1, 2:
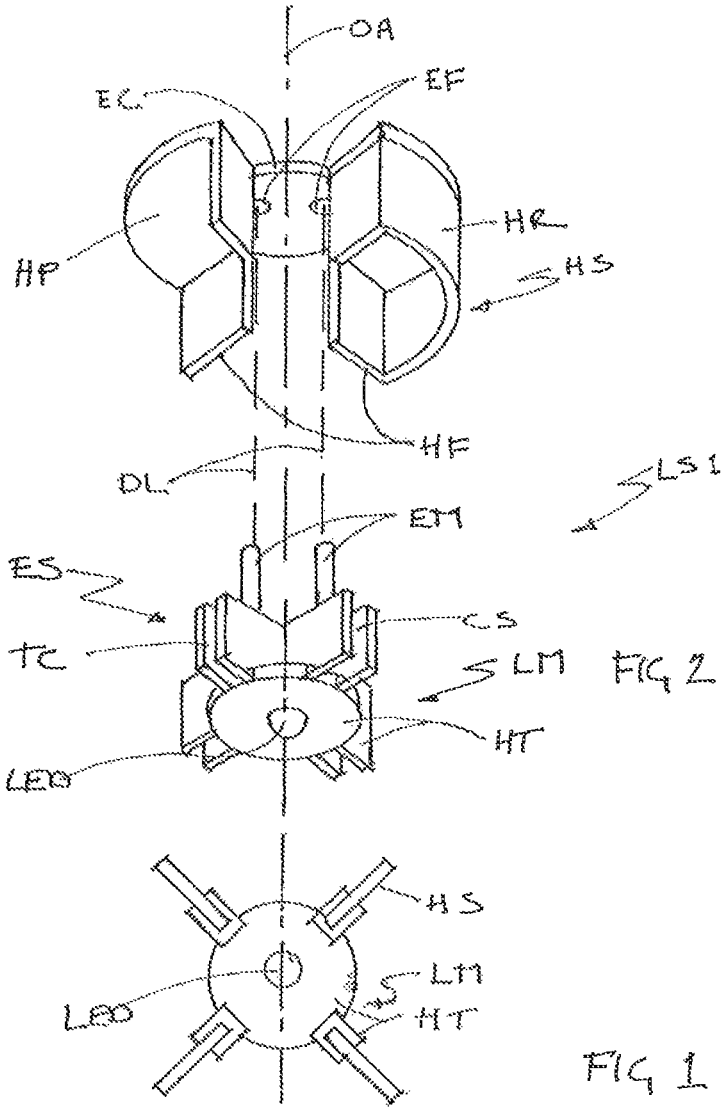
FIG. 1 is a plan view of a lighting component system.
FIG. 2 is a three dimensional diagram of the lighting component system illustrated in FIG. 1.

FIGS. 1 and 2 are a plan view diagram and a 3-dimensional view of a lighting component system LS1 to be used for changing out lighting modules within a luminaire without removal of heat sinks and related hardware from the luminaire itself. This instant invention can be used in many types of luminaires and luminaire systems that are inclusive of such optical systems that are incorporated herein by reference in U.S. Pat. Nos. 5,676,457; 5,897,201; 7,118,253; 7,600,894; 7,677,760; 7,597,453; 6,616,305; 6,536,921; 6,851,833, and PCT/US/06/49369. In addition this instant invention can be applied to various types of light bulbs such as PAR and R lamps, T lamps, and decorative lamps such as candelabra bulbs, as well as indoor and outdoor luminaire systems.

The components which form the component lighting system LS1 are (as illustrated in FIG. 2) as follows:

A light module LM comprising a light emitting diode LED disposed substantially on an optical axis OA, the light emitting diode LED mounted to a heat transfer component HT (for removing heat from the LED); the heat transfer component HT having contact surfaces CS that are designed to interface with heat sink assembly HS in such a manner that attaching and detaching the heat transfer HT subcomponent TC from the heat sink HS is accomplished by manually moving the light module(s) LM in a direction along the optical axis OA.

The heat sink assembly component HS comprises a series of heat sink fins HF which are radially disposed outwardly from the optical axis OA and connected to a common portion of the heat sink assembly component HS which can be a ring HR, plate HP, or other shapes having structural and enhanced heat dissipating functions and that holds the fins HF together. At least one of the surfaces of at least one of the fins has a heat transfer function and an attachment function to the contact surfaces CS of the light modules LM.

The lighting component system LS1 further comprises an electrical system ES for providing current from an appropriate power source to the light module(s) LM. In the embodiment illustrated in FIGS. 1 and 2, male electrical contact pins EM that are disposed on the light module component LM are substantially parallel to the optical axis OA so that the light module LM can be manually guided along the optical axis OA to attach the light module LM to the heat sink component HS. The male pins EM which are disposed in alignment to the heat fins HF, (illustrated by dotted lines DL) are pressed into and make contact with the female pin connectors EF. The female pin connectors EF are positioned within an electrical connector EC which are substantially disposed about optical axis OA. The electrical connector EC may or may not be attached to heat sink assembly HS.

Figure 3:
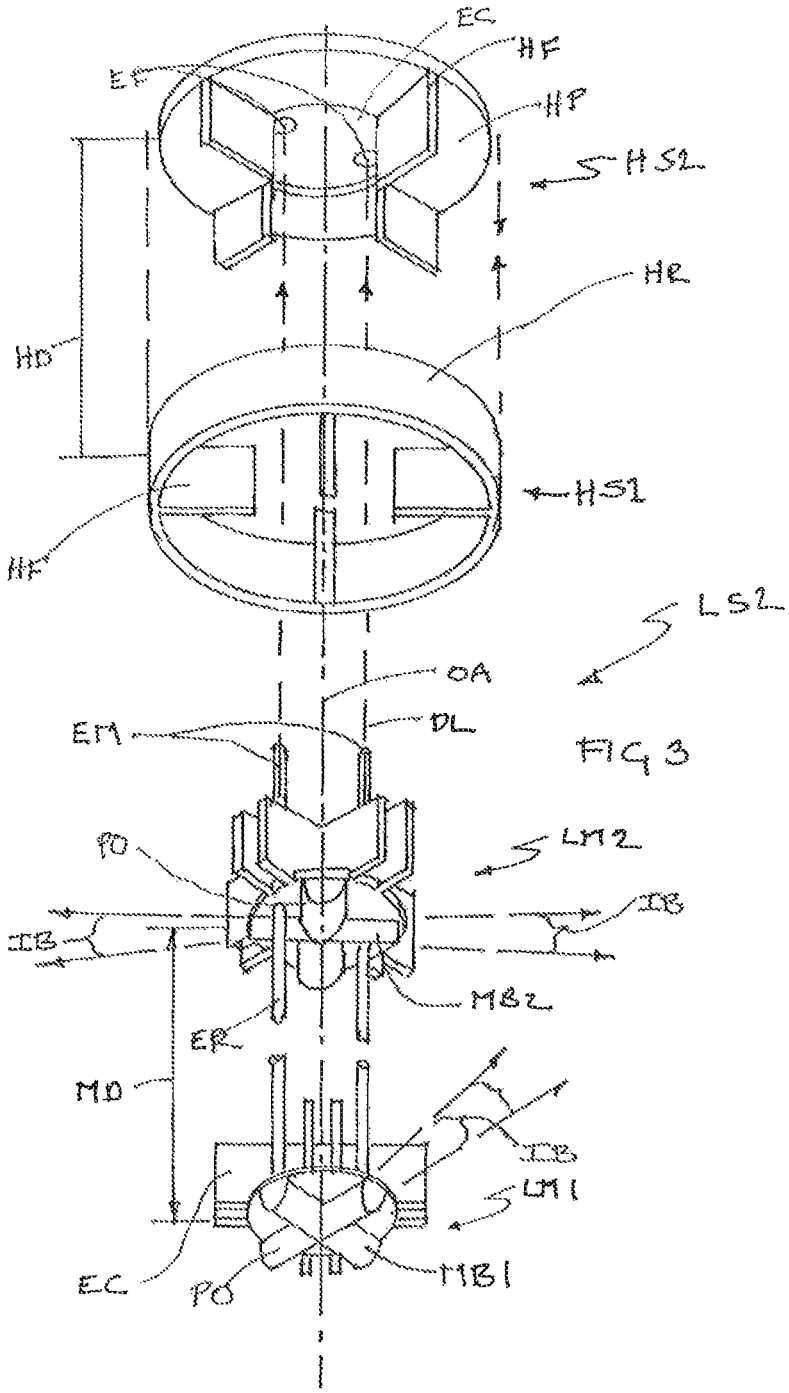
FIG. 3 is a three dimensional diagram of a lighting component system similar to that shown in FIGS. 1 and 2.

FIG. 3 is a three-dimensional exploded diagram of lighting component system LS2 similar to lighting component system LS1 shown in FIGS. 1 and 2, further illustrating and containing:

At least two light modules LM1 and LM2 each light module containing a multibeam projector MB1 and MB2 (respectively), each further containing heat transfer elements (HT as in FIG. 2) which in this embodiment are in the form of "clips" EC. The orientation of clips EC of each of the light modules is radially offset from another of the light modules in correspondence to how the multibeam collimators MB1 and MB2 are offset from each other and to the light distribution functions (including the direction of beam projections IB) that at least partially surround the light module LM2 illustrated in this figure. The heat sink fins HF are so disposed as to not interfere with or obstruct said individual beams IB projected by the multiple beam projectors.

As in all the embodiments discussed, the number of light modules (and their associated optics) are not limited to two as shown in FIG. 3.

Also illustrated are electrical continuity rods ER that connect light modules LM which are disposed between the individual projecting optical elements PO of the multibeam projectors MB1 and MB2, and are positioned so as not to obstruct their associated individual beams IB. In other embodiments the electrical connecting rods ER may end as male contact pins EM. One or more light modules may include male contact pins EM that connect directly into sequentially disposed light modules that contain female pin connectors EF which would allow for the change out or replacement for each light module individually.

The distance MD between light modules LM1 and LM2 corresponds directly to the distance HD between heat sink assemblies HS1 and HS2. These distances are determined by the heat dissipation and optical/light function requirements and or the lighting functions of the component systems as used in conjunction with its corresponding luminaire. In such co-functional situations the luminaire can provide support between heat sink assemblies and or comprise heat sink assemblies as structural parts of the luminaire. In other embodiments wherein the component system LS co-functions with a luminaire, the luminaire can comprise optics such as reflectors, refractors and light guides to reshape and or redirect light emanating and or projecting from the light modules comprising the component system. In still other embodiments, the light modules, heat sink assemblies, and electrical systems may substantially comprise the entire luminaire but may still require structural, electronic, or environment related connecting hardware for complete functioning of the luminaire.

Figure 4:
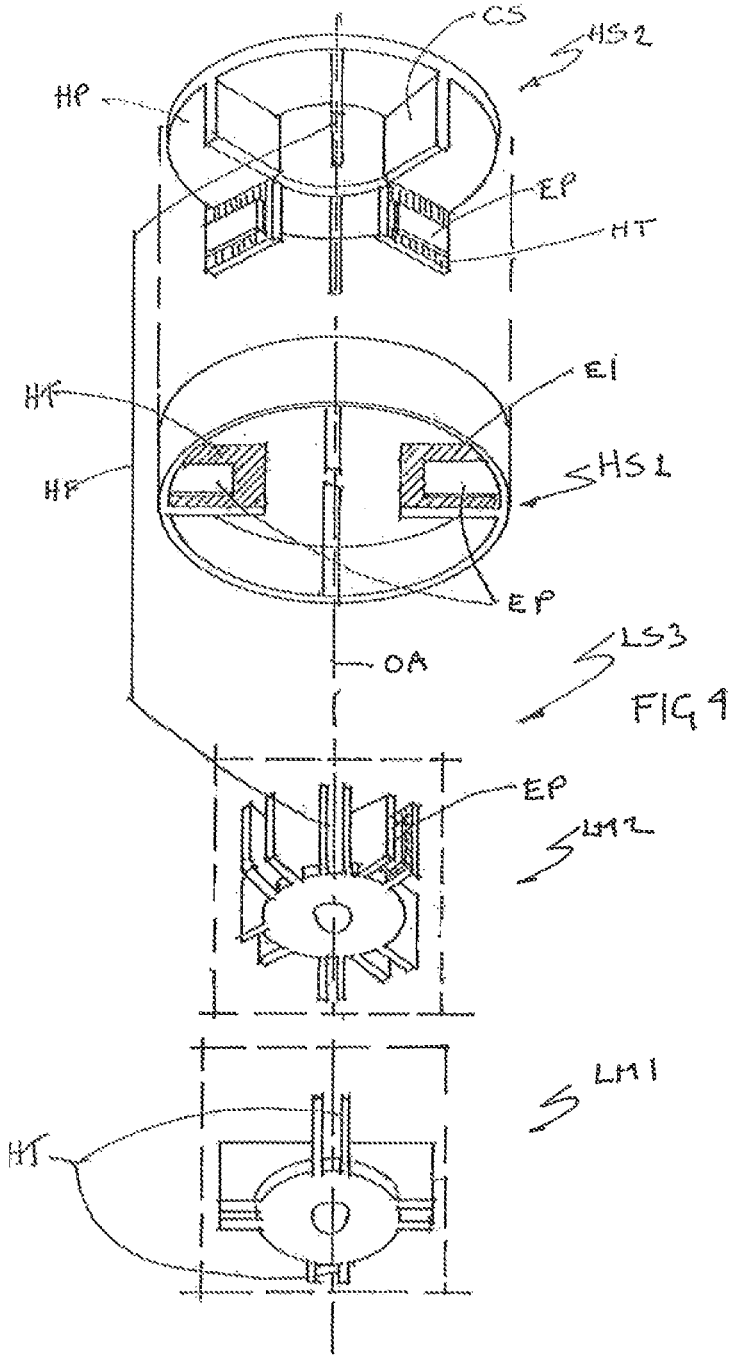
FIG. 4 is a three dimensional diagram of a lighting component system similar to that shown in FIG. 3.

FIG. 4 is a three dimensional diagram of a lighting component system LS3 similar to the lighting component system illustrated in FIG. 3 differing in that (for graphic purposes of simplification) the individual light modules LM1 and LM2 (in this embodiment) are not shown to comprise light controlling optics, although any type of light controlling optics such as those shown in the enclosed embodiments herein may be employed. Also shown, there is no direct electrical connection (continuity) between light modules LM, allowing each of the light modules to be changed or replaced individually so as not to disconnect continuity between connected (installed) light modules when another light module is removed.

At least one of the heat transfer surfaces HT of at least one of the light modules LM1 and LM2 is shown to comprise an electrical contact pad EP which makes contact with an associated electrical contact pad EP mounted to heat sink fin HF. Contact pad EP is insulated from heat sink fin HF by an insulating material disposed between electrical contact pad EP and heat transfer surface HT of heat sink fin HF on the heat sink assemblies HS1 and HS2.

Figure 5:
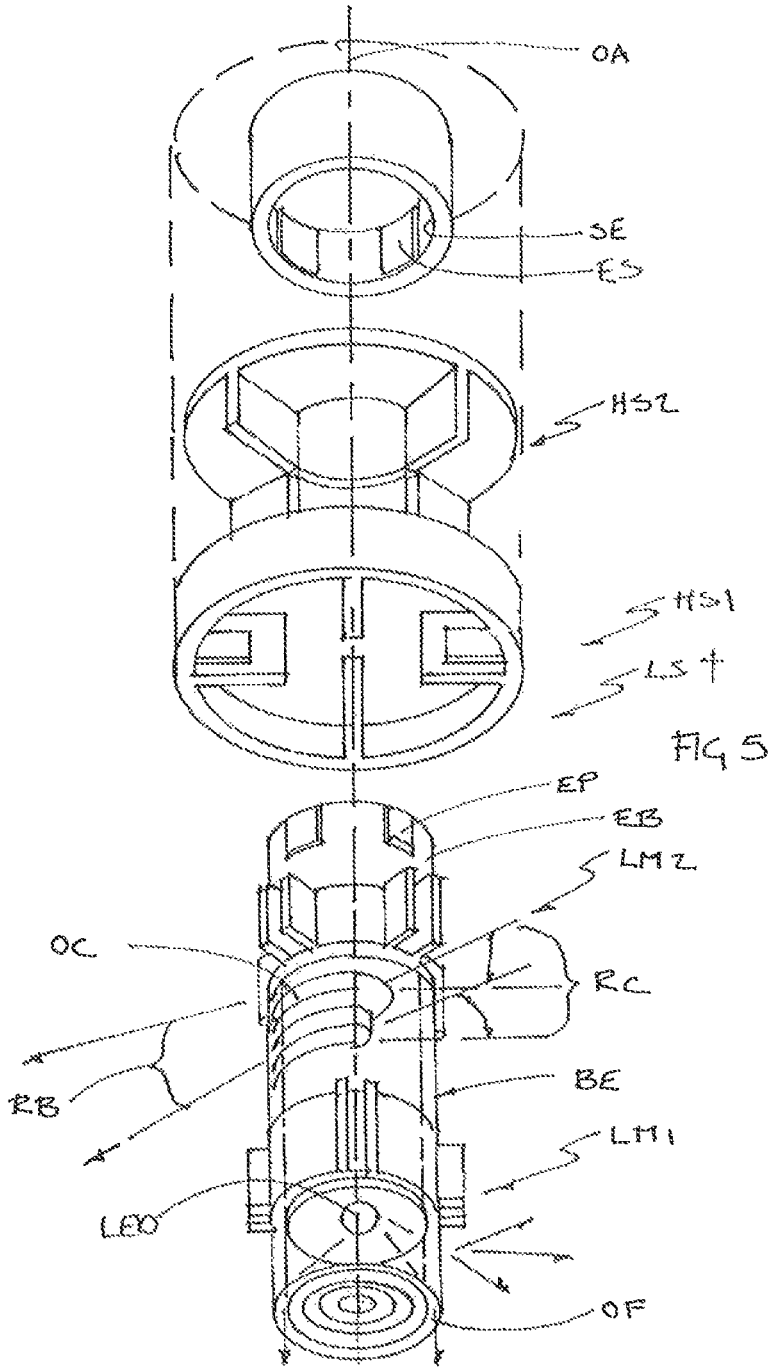
FIG. 5 is a three dimensional diagram of a lighting component system similar to that shown in FIG. 3 further comprising a bulb-like envelope.

FIG. 5 is a three dimensional diagram of a lighting component system LS4 similar to the lighting component system illustrated in FIG. 3 differing in that and further including:

A light bulb-like enclosure BE of light transmissive material such as glass or plastic that is at least partially surrounding at least one of light modules LM1 and LM2, and in other embodiments surrounding and connecting at least two of light modules. The bulb-like enclosure BE has a cylindrical (T lamp) shape, or may have other cross-sectional geometric or configurations and light bulb shapes. The shape and surface of the enclosure may contain various types of lenses for differing light projecting configurations and applications. Such various types of lenses OC can be employed to project radial beam(s) RB, and radially collimated beam(s) RC. Multiple beam collimating optics MB1 and MB2 (shown in FIG. 3), Fresnel optics, prismatic optics and diffusing optics can also be employed.

Also illustrated is electrical contact base EB that plugs into an electrical socket ES, the base EB (which is shown in this embodiment is connected to light module LM2) is shown to comprise spring-type contact pads EP that compress onto electrical contact pads ES located within socket SE. In other embodiments at least one or either of the electrical contacts can be disposed on the top of the base and on the bottom of the socket as in single and or double contact bases. In other embodiments the spring type contact pads EP may be disposed with socket SE.

FIG. 5 further illustrates two types of electrical continuity between light modules LM1 and LM2, and their connecting component(s). The electrical continuity between light module LM1 and its connecting component (as shown and described in connection with FIG. 4) are such that the electrical connection and thermal connections are made within the same subcomponents. In this embodiment electrical continuity and thermal transfer from light module LM2 is achieved at different locations and by different subcomponents.

Figure 6:
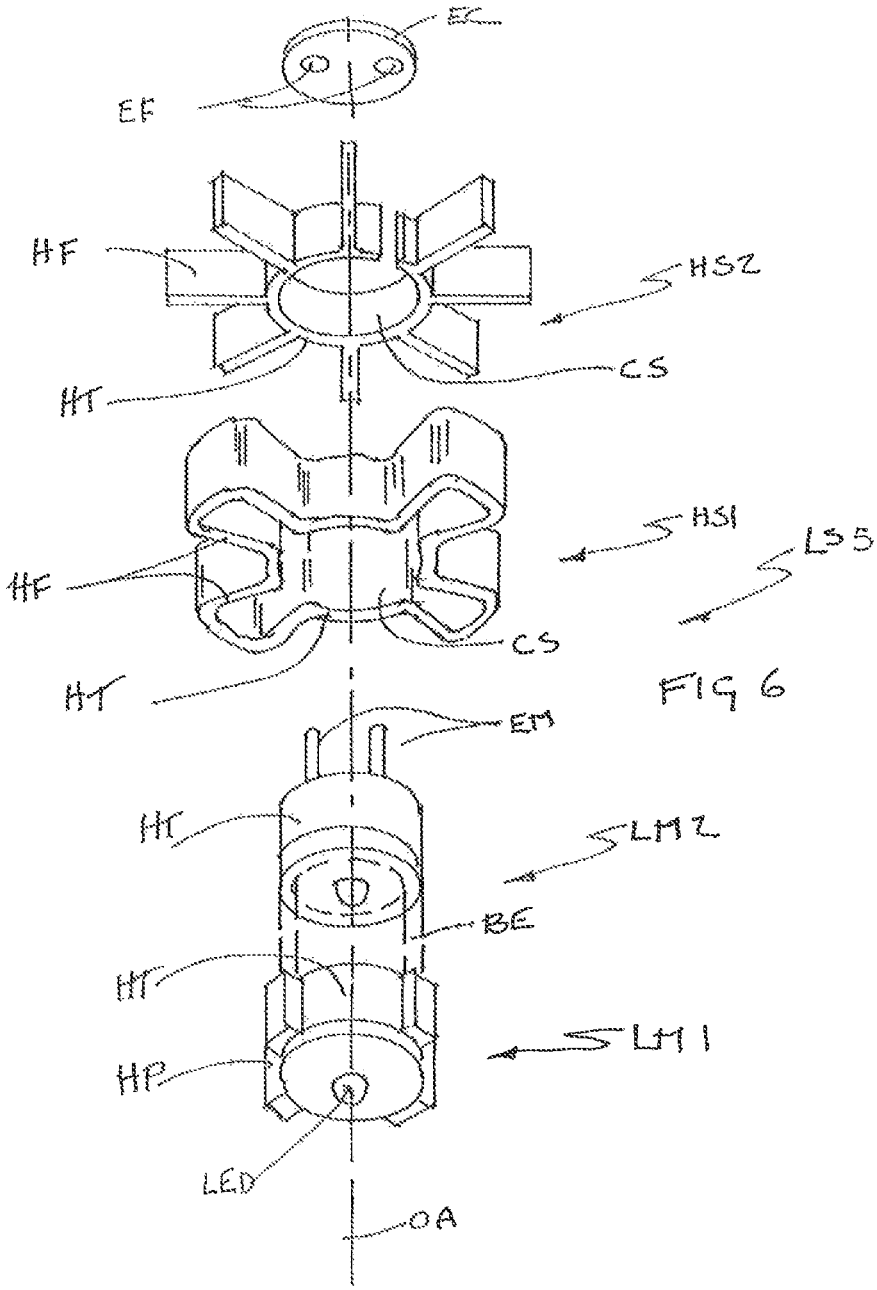
FIG. 6 is a three dimensional diagram of a lighting component system similar to that shown in FIG. 5 further comprising spring like compressive heat sinks.

FIG. 6 is a three dimensional diagram of a lighting component system LS5 designed for lamp changing that comprises alternate type modules LM1 and LM2 and respective alternate type heat sink assemblies HS1 and HS2 (as described in FIGS. 2 through 5), differing in that and further including: heat sink assemblies HS1 and HS2 that contain spring-like subcomponents that provide a compressive force from the heat transfer element of the heat sink assembly HS1 and HS2 to and on the heat transfer elements HT on the lighting modules LM1 and LM2.

The compressive force provided by the heat transfer element HT (subcomponent of heat sink assembly HS1) is created by a spring-like configuration of the heat sink fins HF of heat sink assembly HS1. The compressive force provided by the heat transfer element HT (subcomponent of heat sink assembly HS2) is created by a split S and an expansion in the ring shaped heat transfer element HT. Both heat sink assemblies HS1 and HS2 include a spring-type metal alloy within the heat sink material. In another embodiment a spring in the form of a compressive band can be integrated into the heat sink assembly so disposed as to surround and create a compressive force around heat transfer element HT of light module LM. In other embodiments a circular clamp (configured similarly to a hose clamp) can be so disposed as to surround and create a compressive force around the heat transfer element HT. In such an embodiment the clamp could be manually loosened to remove and replace the typical light modules LM1 and LM2.

In some embodiments bulbs (illustrated by bulb enclosure BE) may include internal heat sinks. In other embodiments the bulb like enclosure BE may include non-detachable heat sinks. Also illustrated are male connector pins EM and female connectors EF that are located in electrical socket ES.

Figure 7:
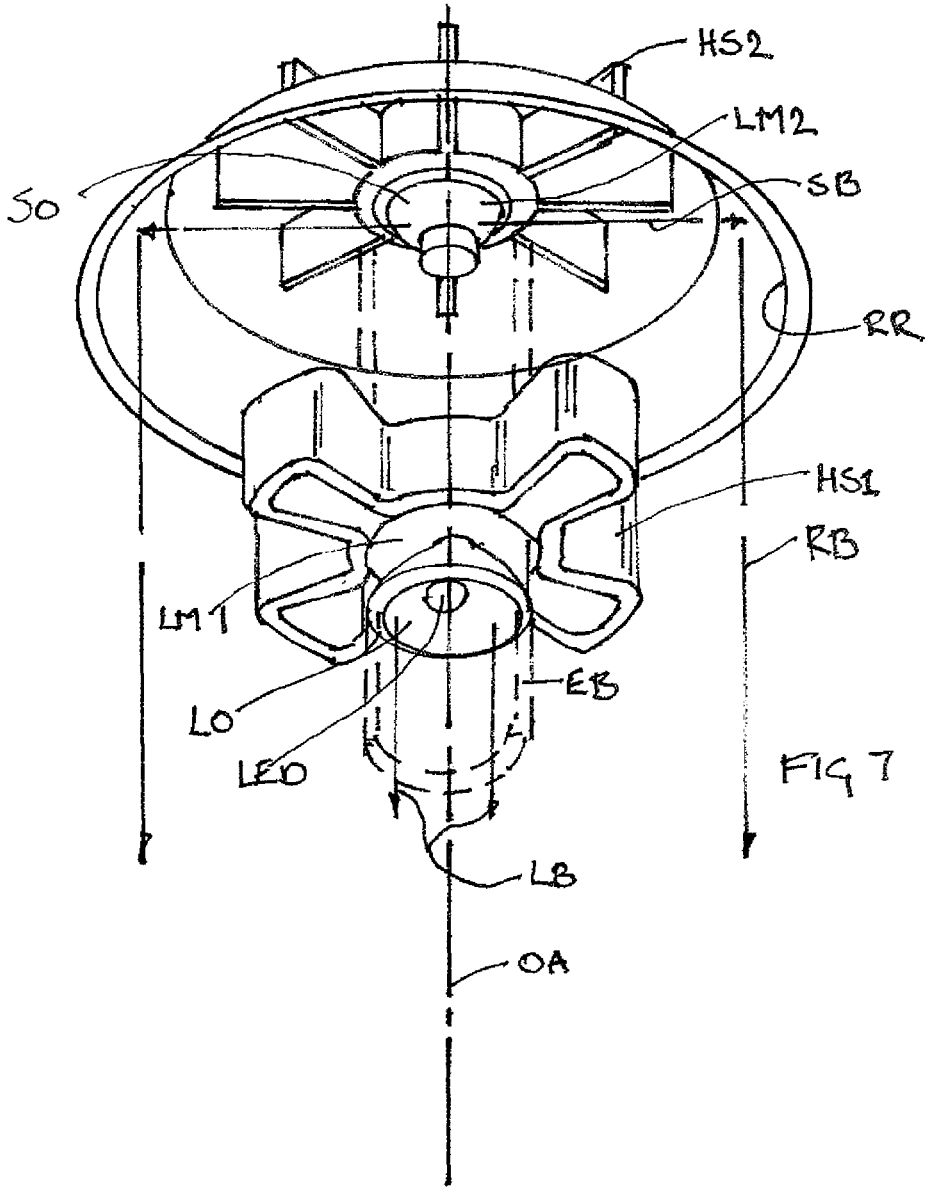
FIG. 7 is a three dimensional diagram of a lighting component system applied to a luminaire.

FIG. 7 is a three dimensional diagram of a luminaire LU containing components similar to the components contained within the lighting component systems illustrated in FIGS. 1 through 6. In this embodiment luminaires LU having a specific function which is down lighting. This is achieved by applying optical principles and configurations formerly described and that are incorporated herein by reference to the patents listed above and in connection with the description of FIGS. 1 and 2. Light module LM1 within heat sink assembly HS1 includes a linear light collector such as a parabolic or ellipsoidal reflector that at least partially surrounds the light emitting diode LED, and which projects beam LB forward, surrounding optical axis OA and away from luminaire LU. Light module LM2 includes a side emitting lens SO at least partially surrounding its associated light emitting diode LED which projects a radial beam SB onto ring reflector RR which in turn reflects and directs beam RB which surrounds (but is not obstructed by) heat sink assembly HS1 in substantially the same direction as linear beam LB.

In another embodiment, each of the modules can project different types of illumination, e.g., one module (such as LM2) projecting a radial beam onto a reflector for down lighting application. One module such as LM1 (the light emitting diode LED surrounded by a side emitting lens) can simultaneously project an indirect beam onto a ceiling plane for indirect lighting applications.

Figure 8:
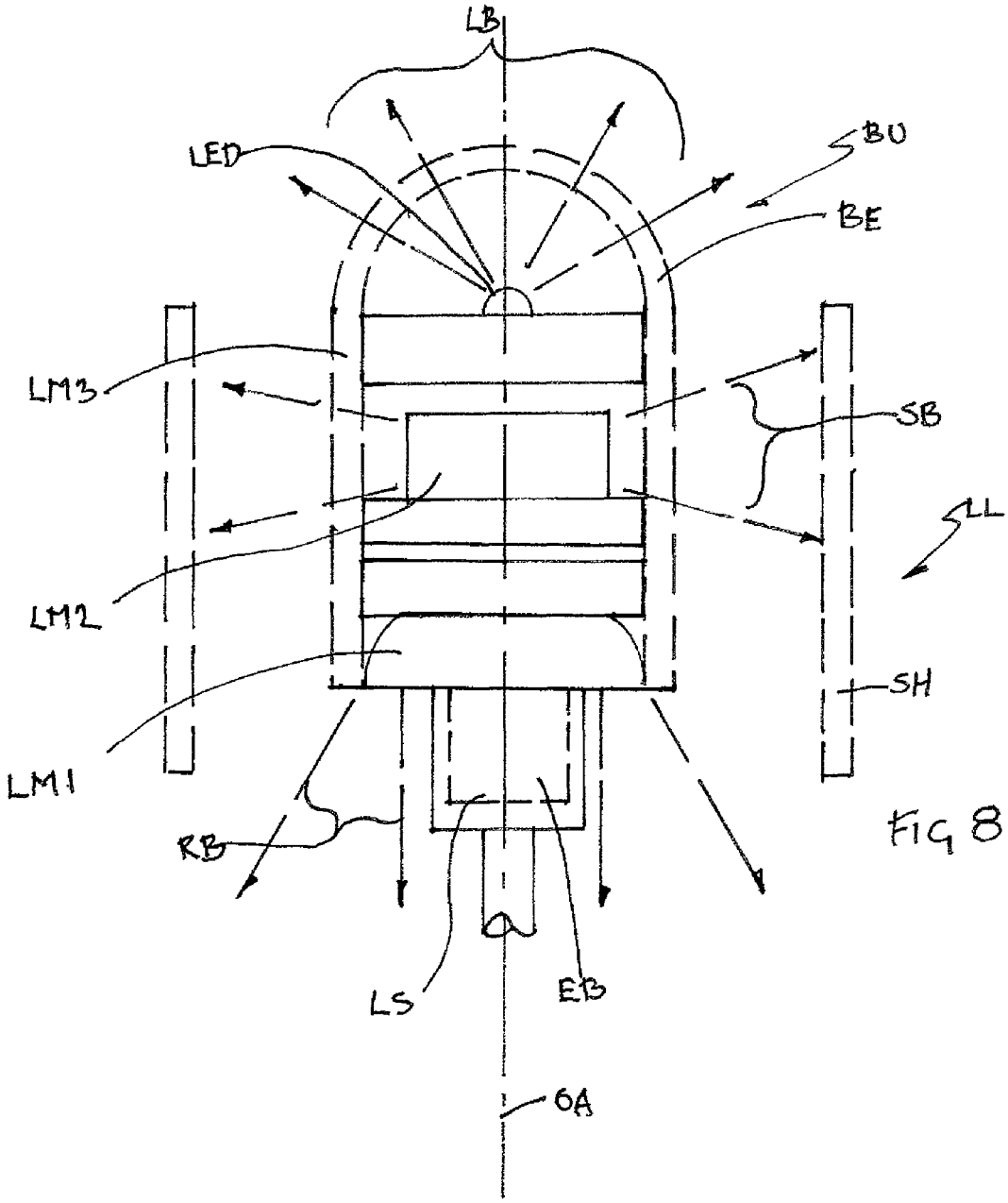
FIG. 8 is a diagram of a light bulb comprising a lighting component system.

FIG. 8 is a side view/sectional diagram of a multifunctional light bulb BU disposed within a luminaire LL (such as a table lamp). Multifunction light bulb BU includes a combination of at least one of the light modules (as described in FIGS. 1 through), which are further surrounded by a bulb enclosure BE. Bulb enclose BE having at least one of the light interface aspects (that are described in FIG. 5) between light modules and the space surrounding bulb enclosure BE. The specific lighting functions of the three light modules illustrated are as follows: Light module LM1 includes a configuration of optics that collects and projects light from its associated light emitting diode as a beam RB which surrounds and is projected in the direction of the optical axis OA, beam RB having a cross-section so shaped so as not to be obstructed by either the bulb base EB or the luminaire socket LS. Light module LM2 (sharing the same optical axis OA with light module LM1) includes a configuration of optics that project a radial beam SB outward and away from the optical axis OA, and as illustrated in this embodiment onto the shade SH of lamp style luminaire LL. Light module LM3 including at least one light emitting diode LED that is disposed to emit and direct light LB substantially in the opposite direction as light projected by light module LM1. Light module LM3 can include optics directly surrounding light emitting diode LED and disposed between the light emitting diode LED and the bulb enclosure BE, or bulb enclosure EB can include optical light control elements such as those described in FIGS. 3, 5, 7, and 8. In some embodiments, each of the light modules can be dimmed or switched independently from each other. The application of the multi-function bulb BU within a luminaire as described provides a high level of efficiency, utility and precision of required illumination by projecting light directly to where it is required. In other embodiments at least two of the light modules can provide the same type of illumination. In other embodiments only one can be utilized. One light module can simultaneously provide more than one type of illumination.

Figure 9:
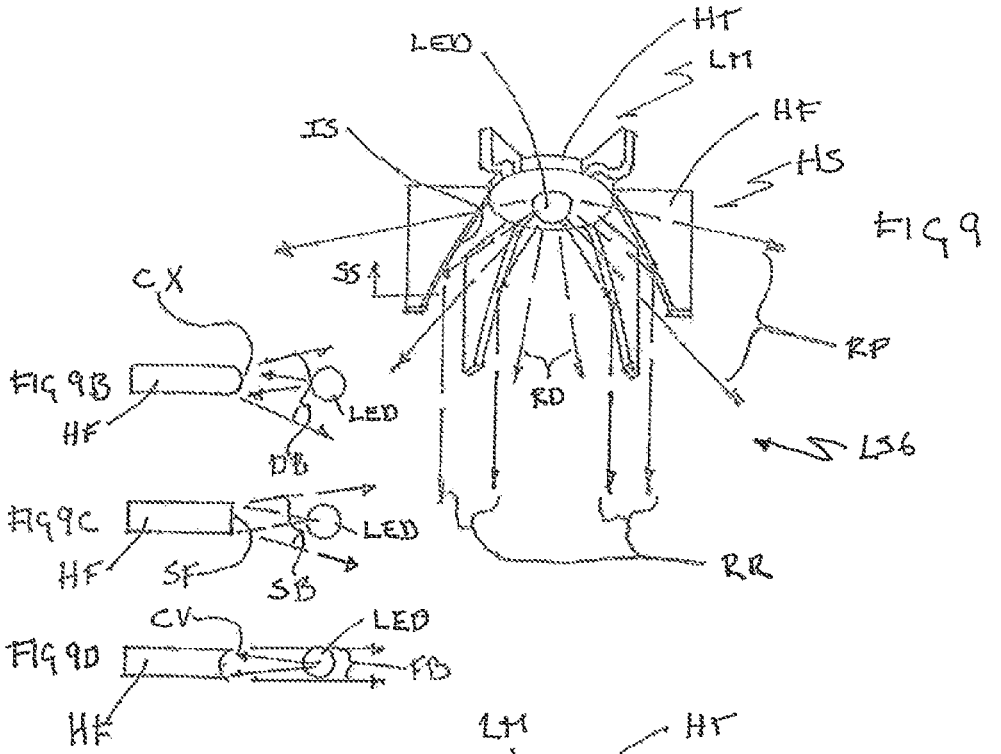
FIG. 9 is a three dimensional diagram of a lighting arrangement.

FIG. 9 is a three dimensional diagram of a lighting component system LS6 which includes a light module LM further including a light emitting diode mounted to a thermal transfer board HT (previously referred to as a heat transfer component) which is thermally connected to heat sink assembly HS. Heat sink assembly HS includes at least two heat sink fins HE that radiate outwardly from, and at least partially surround, light module LM. At least one of the edges of at least one of heat sink fins HF includes a reflective surface IS that is positioned in relationship to the light module LM so as to reflect a portion of the light emanating from the light emitting diode LED away from the light module LM as reflected rays PR, while allowing a portion of the light emanating from the light emitting diode LED to pass by and between the heat sink fins HF as rays RP. Rays RP, as well as forward projecting rays RR can be reflected or refracted by optical components such as those in FIGS. 5, 7, and 8. The reflective surface(s) IS may include parabolic, ellipsoidal, and circular (among other) curvatures or can be flat.

Figure 9A:
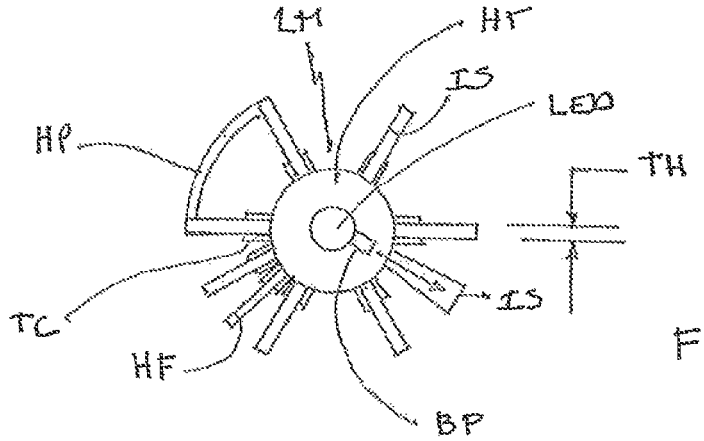
FIG. 9A is a plan view of the arrangement.

FIG. 9A is a plan view facing the light component system LS shown in FIG. 9, further illustrating and describing that the thickness TH of each of the reflective surface IS of the heat sink fins HF can vary from fin to fin and therefore increase or decrease the percentage of light as well as the cross-sectional symmetry of the beam(s) projected from the light component system. Also illustrated in FIG. 9A is that the number of radial heat sink fins HF can vary. At least one single beam projecting optic BP of a multiple beam projector is shown to project at least a partially collimated beam onto at least one of the heat sink reflectors IS. The types of thermal connection between the thermal transfer board HT and the heat sink fins HF are explained in connection with FIGS. 1 thru 7.

FIGS. 9B, 9C and 9D are cross-sectional diagrams taken through section SS in FIG. 9 illustrating three of the possible types of cross-sections of the reflective surfaces of heat sink fins HF and the section thru their corresponding reflected beam. The reflective surface of heat sinks in FIGS. 9B, 9C, and 9D, respectively, are: convex surface CX reflecting light emanating from the light emitting diode LED as diverging beam DB; flat surface SF reflecting light emanating from the light emitting diode LED as beam SB having substantially the same angular ray pattern as the rays emanating from the light emitting diode LED; concave surface CV reflects light emanating from the light emitting diode LED as a focused beam or a collimated beam FB.

In some embodiments the heat sink assembly HS may be not be removable from their associated light module and be contained within and or surrounding the bulb envelope, or light modules can be detachable from their associated heat sink so that the bulb may be removed and replaced from a luminaire without having to remove and or replace the heat sinks.

The invention claimed is:

1. A composite lighting component system comprising: a first component comprising one or more light modules, each of the one or more light modules disposed on a common optical axis, and at least one of the one or more light modules including each of the following subcomponents:

at least one LED to provide a flux of radiant illumination;

a first heat transfer element onto which the LED is mounted to remove heat generated from said LED, said first heat transfer element including a first mechanical element configured to provide a secure and removable attachment and having a thermal interface to transfer heat onto a second component which is a heat sink assembly;

the second component heat sink assembly including at least one second heat transfer element that contains a second mechanical element configured to provide a secure and removable attachment and a thermal interface with the first heat transfer element of the first component lighting module, the removable attachment and thermal interface between the light module(s) and the light modules respective heat sinks allowing for the replacement of the light module independent of the heat sink assembly; and the composite lighting component system including a third component which is an electrical continuity system that supplies electrical current and continuity to said LED(s), the third component including electrically conductive subcomponents, at least one of the sub components is so configured and disposed as not to obstruct light emanating from the light module.

2. A composite lighting component system as in claim 1 wherein at least one of said light modules comprising an optical sub component at least partially surrounding said LED for projecting a shaped beam away from the light module.

3. A composite lighting component system as in claim 2 wherein one said optical sub components is a side emitting radially projecting lens at least partially surrounding the LED for projecting a radial beam away from the optical axis.

4. A composite lighting component system as in claim 2 wherein said optical subcomponent is substantially disposed concentric to said optical axis protecting a beam along and substantially surrounding said optical axis.

5. A composite lighting component system as in claim 2 wherein said optical subcomponent is a multiple beam projector which divides and projects the light from the LED into at least two individual beams away from the optical axis.

6. A composite lighting component system as in claim 2 wherein each light module can be removed or secured to its associated heat sink independently from each other light module.

7. A composite lighting system as in claim 2 wherein at least one of said modules contains a bulb base, and at least one light module contains an optical(s) sub component for projecting a beam that substantially surrounds the optical axis and is projected in the direction of the bulb base, the cross-sectional shape of said beam being such as to not be obstructed by the bulb base.

8. A composite lighting component system as in claim 1 wherein there is a bulb enclosure that at least partially surrounds the light module(s), at least a portion of the light module(s) heat transfer element(s) passing thru to be disposed on the outside of said bulb enclosure for making contact with the second component heat sink, at least portions of said enclosure comprising optical materials allowing light emanating from said light modules to pass through.

9. A composite lighting component system as in claim 1 wherein the subcomponent heat transfer element(s) are configured as pressure clips which contain sufficient surface area for efficient thermal transfer to the heat transfer elements of the second component heat sink, the clips providing a secure yet removable attachment between the first and second component(s).

10. A composite lighting component system as in claim 1 wherein said heat transfer elements of said first and second components contain electrical contact elements so that thermal transfer and electrical continuity is accomplished simultaneously.

11. A composite lighting system as in claim 10 wherein the heat transfer and electrical continuity between said components are accomplished thru the use of threaded mechanical devices being subcomponents of said first, second and third components.

12. A composite lighting component system as in claim 1 wherein at least one of the one or more light module(s) is at least partially surrounded by a bulb-like enclosure, at least one of the one bulb-like enclosure at least partially surrounding at least one light module comprising an electrical contact base, each bulb-like enclosure used individually or in stacked arrangements within a luminaire, at least one bulb-like enclosure comprising one or more optical elements for projecting light in the direction of the luminaire.

13. A composite lighting system as in claim 1 wherein at least two said light modules projects and provides a different light pattern.

14. A composite lighting system as in claim 1 wherein the heat transfer element of one of the first or second components is a clamp type ring designed to tighten around a ring or disk shaped mechanical element of its associated heat transfer element of the first or second components.

* * * * *